US008047303B2

(12) United States Patent
Donnally et al.

(10) Patent No.: US 8,047,303 B2
(45) Date of Patent: Nov. 1, 2011

(54) DRILLING RIG DRAWWORKS INSTALLATION

(75) Inventors: Robert Benjamin Donnally, Shanghai (CN); Chunqiao Ren, Shanghai (CN); Stuart Arthur Lyall McCurdy, Edmonton (CA); Xi Lin Liu, Puyang (CN); Hui Chun Sheng, Shanghai (CN); Yan Yu, Shanghai (CN)

(73) Assignee: National Oilwell Varco L.P., Houston, TX (US)

( * ) Notice: Subject to any disclaimer, the term of this patent is extended or adjusted under 35 U.S.C. 154(b) by 916 days.

(21) Appl. No.: 12/074,232

(22) Filed: Feb. 29, 2008

(65) Prior Publication Data

US 2009/0218137 A1 Sep. 3, 2009

(51) Int. Cl.
*E21B 15/00* (2006.01)

(52) U.S. Cl. ..... 175/57; 175/162; 175/202

(58) Field of Classification Search ..... 175/57, 175/162, 202; 52/123.1
See application file for complete search history.

(56) References Cited

U.S. PATENT DOCUMENTS

| | | | | |
|---|---|---|---|---|
| 2,857,993 | A | 10/1958 | Terrell | 189/11 |
| 2,993,570 | A | 7/1961 | Bender | 52/118 |
| 3,201,091 | A | 8/1965 | Woolslayer et al. | 51/120 X |
| 3,228,151 | A | 1/1966 | Woolslayer et al. | |
| 3,262,237 | A | 7/1966 | Jenkins et al. | 52/116 |
| 3,340,938 | A | 9/1967 | Wilson | 173/28 |
| 3,749,183 | A | 7/1973 | Branham et al. | 173/151 |
| 3,807,109 | A | 4/1974 | Jenkins et al. | 52/120 |
| 3,922,825 | A | 12/1975 | Eddy et al. | 52/116 |
| 3,942,593 | A | 3/1976 | Reeve, Jr. et al. | 173/23 |
| 3,981,485 | A | 9/1976 | Eddy et al. | 254/186 R |
| 4,021,978 | A | 5/1977 | Busse et al. | 52/118 |
| 4,024,924 | A | 5/1977 | Hauck | 173/151 |
| 4,103,503 | A | 8/1978 | Smith | 61/97 |
| 4,135,340 | A * | 1/1979 | Cox et al. | 52/115 |
| 4,138,805 | A | 2/1979 | Patterson | 52/118 |
| 4,221,088 | A | 9/1980 | Patterson | 52/116 |
| 4,267,675 | A | 5/1981 | Cochran | 52/118 |
| 4,269,009 | A | 5/1981 | Lawrence | 52/116 |
| 4,269,395 | A | 5/1981 | Neuman et al. | 254/386 |
| 4,290,495 | A | 9/1981 | Elliston | 175/85 |
| 4,292,772 | A | 10/1981 | Borg et al. | 52/118 |
| 4,305,237 | A | 12/1981 | Borg et al. | 52/116 |
| 4,368,602 | A | 1/1983 | Manten | 52/115 |
| 4,371,046 | A | 2/1983 | Read | 175/57 |
| 4,375,892 | A | 3/1983 | Jenkins et al. | 280/43.23 |
| 4,438,904 | A | 3/1984 | White | 254/311 |

(Continued)

OTHER PUBLICATIONS

U.S. Appl. No. 12/069,913, filed Feb. 13, 2008, Chehade et al.

(Continued)

*Primary Examiner* — William P Neuder
(74) *Attorney, Agent, or Firm* — Williams, Morgan & Amerson, P.C.

(57) ABSTRACT

Methods and systems for installing a drawworks on a drilling rig, the method, in certain aspects, including moving a drawworks on movement apparatus on the ground adjacent a drill floor of a rig, connecting the drawworks to the drill floor, moving the movement apparatus away from the rig, and raising the drill floor with the drawworks thereon using raising apparatus of a rig substructure supporting the drill floor. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

21 Claims, 18 Drawing Sheets

U.S. PATENT DOCUMENTS

| | | | | |
|---|---|---|---|---|
| 4,478,015 | A | 10/1984 | Lawrence et al. | 52/120 |
| 4,489,526 | A | 12/1984 | Cummins | 52/125.6 |
| 4,569,168 | A | 2/1986 | McGovney et al. | 52/122.1 |
| 4,587,778 | A | 5/1986 | Woolslayer et al. | 52/116 |
| 4,591,006 | A | 5/1986 | Hutchison | 175/52 |
| 4,630,425 | A | 12/1986 | Reed | 52/45.18 |
| 4,684,314 | A | 8/1987 | Luth | 414/745 |
| 4,757,592 | A | 7/1988 | Reed | 29/429 |
| 4,821,816 | A | 4/1989 | Willis | 175/57 |
| 4,831,795 | A | 5/1989 | Sorokan | 52/120 |
| 4,837,992 | A | 6/1989 | Hashimoto | 52/118 |
| 4,899,832 | A | 2/1990 | Bierscheid, Jr. | 173/23 |
| 4,932,175 | A | 6/1990 | Donnally | 52/118 |
| 5,109,934 | A | 5/1992 | Mochizuki | 175/170 |
| 5,251,709 | A | 10/1993 | Richardson | 175/1 |
| 5,342,020 | A | 8/1994 | Stone | 254/269 |
| 5,425,435 | A | 6/1995 | Gregory | 188/77 W |
| 6,029,951 | A | 2/2000 | Guggari | 254/269 |
| 6,182,945 | B1 | 2/2001 | Dyer et al. | 254/340 |
| 6,474,926 | B2 | 11/2002 | Weiss | 414/332 |
| 6,523,319 | B2 | 2/2003 | Bockhorn et al. | 52/651.01 |
| 6,634,436 | B1 | 10/2003 | Desai | 173/1 |
| 6,848,515 | B2 | 2/2005 | Orr et al. | 173/1 |
| 6,860,337 | B1 | 3/2005 | Orr et al. | 173/28 |
| 6,944,547 | B2 | 9/2005 | Womer et al. | 702/7 |
| 6,962,030 | B2 | 11/2005 | Conn | 52/741.1 |
| 6,994,171 | B2 | 2/2006 | Orr et al. | 173/28 |
| 7,155,873 | B2 | 1/2007 | Palidis | 52/702 |
| 7,210,670 | B2 | 5/2007 | Franks | 254/294 |
| 7,306,055 | B2 | 12/2007 | Barnes | 175/57 |
| 7,308,953 | B2 | 12/2007 | Barnes | 175/203 |
| 7,357,616 | B2 | 4/2008 | Andrews et al. | 414/332 |
| 7,377,335 | B2 | 5/2008 | Jones et al. | 175/57 |
| 2004/0212598 | A1* | 10/2004 | Kraus et al. | 345/168 |
| 2005/0193645 | A1* | 9/2005 | Barnes | 52/120 |
| 2005/0236790 | A1 | 10/2005 | Carter | 280/79.11 |
| 2006/0213653 | A1 | 9/2006 | Cunningham et al. | 166/77.1 |

OTHER PUBLICATIONS

U.S. Appl. No. 12/074,258, filed Feb. 29, 2008, Donnally et al.
U.S. Appl. No. 12/074,264, filed Feb. 29, 2008, Donnally et al.
U.S. Appl. No. 12/074,270, filed Feb. 29, 2008, Donnally et al.
Mobile Rigs. National Oilwell. 8 pp., 2005.
Ideal Rig System. National Oilwell. 8 pp. 2004.

* cited by examiner

FIG. 1D
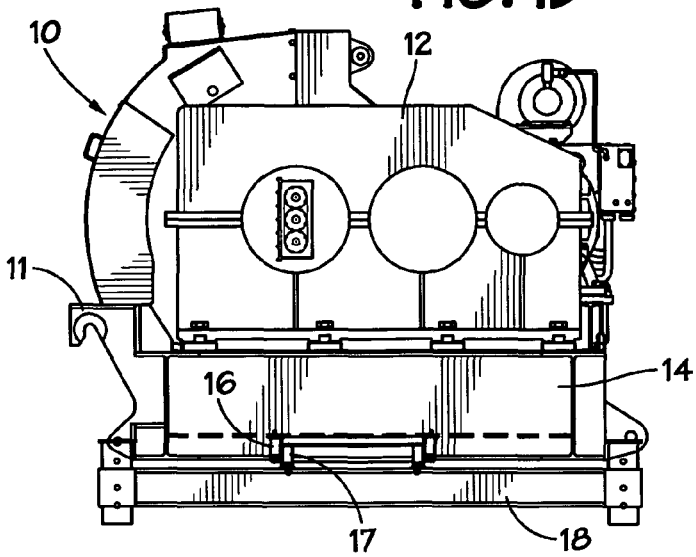
FIG. 1E
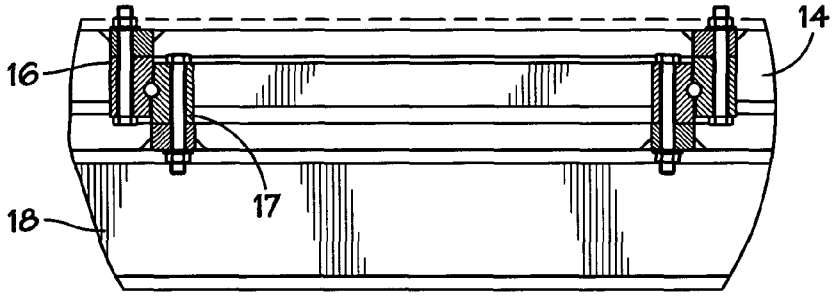
FIG. 1F
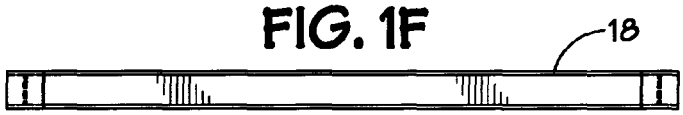
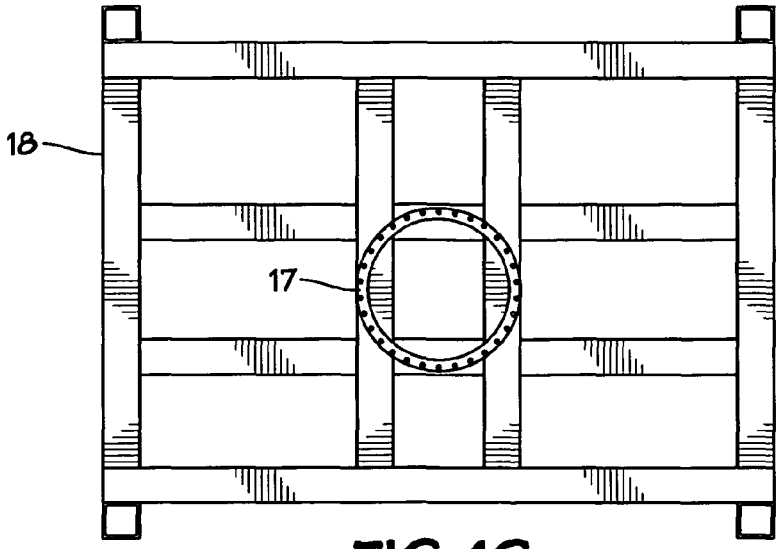
FIG. 1G

FIG. 2A
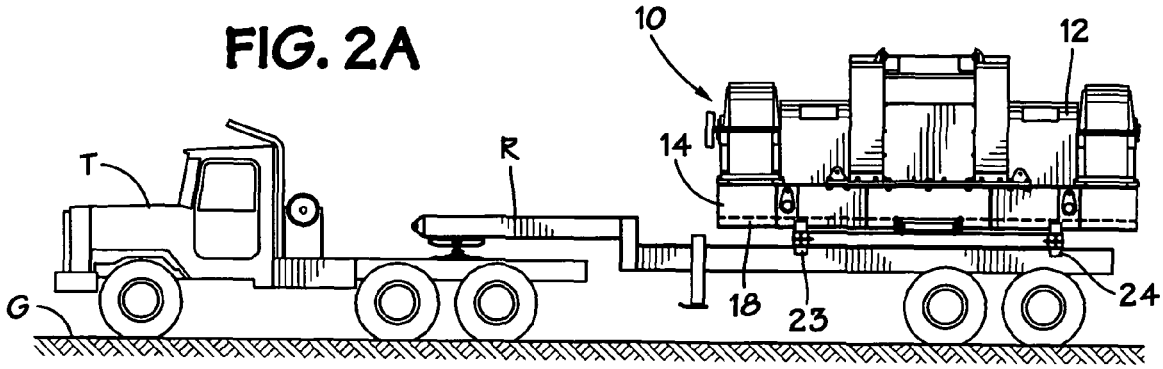
FIG. 2B
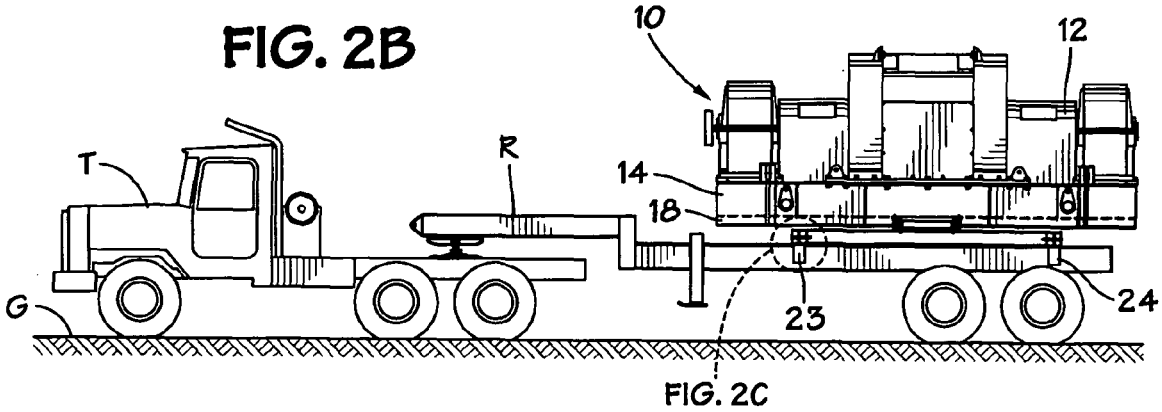
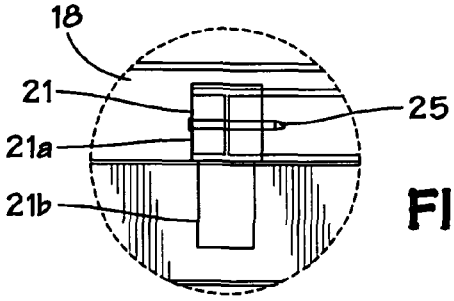
FIG. 2C
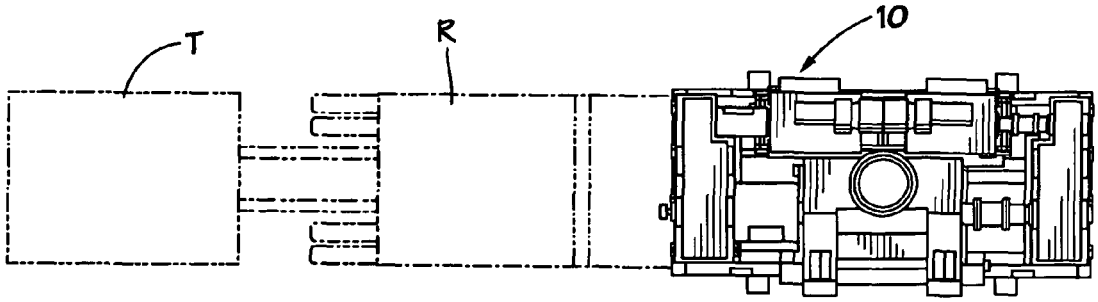
FIG. 2D

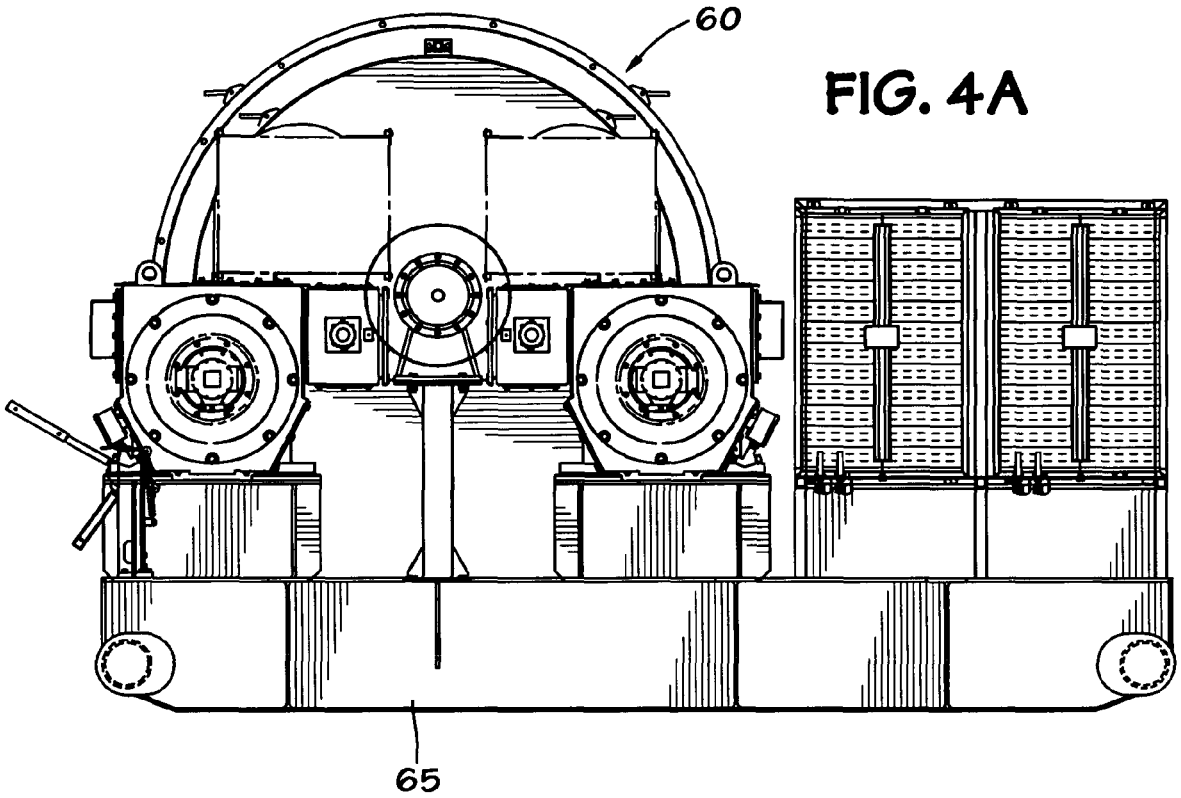
FIG. 4A
FIG. 4B
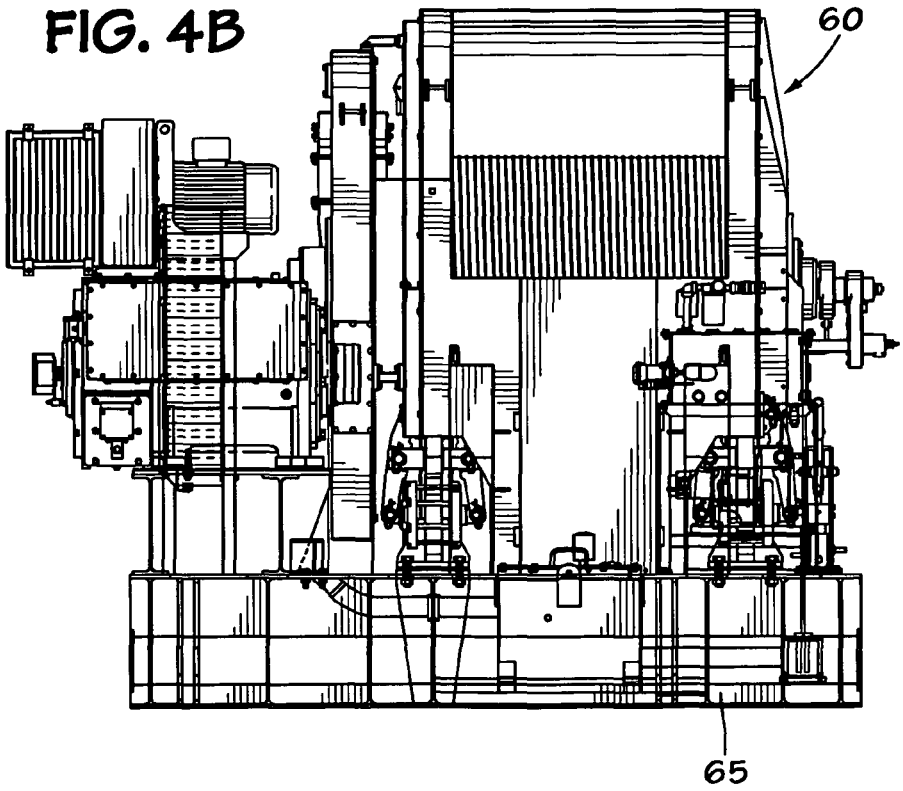

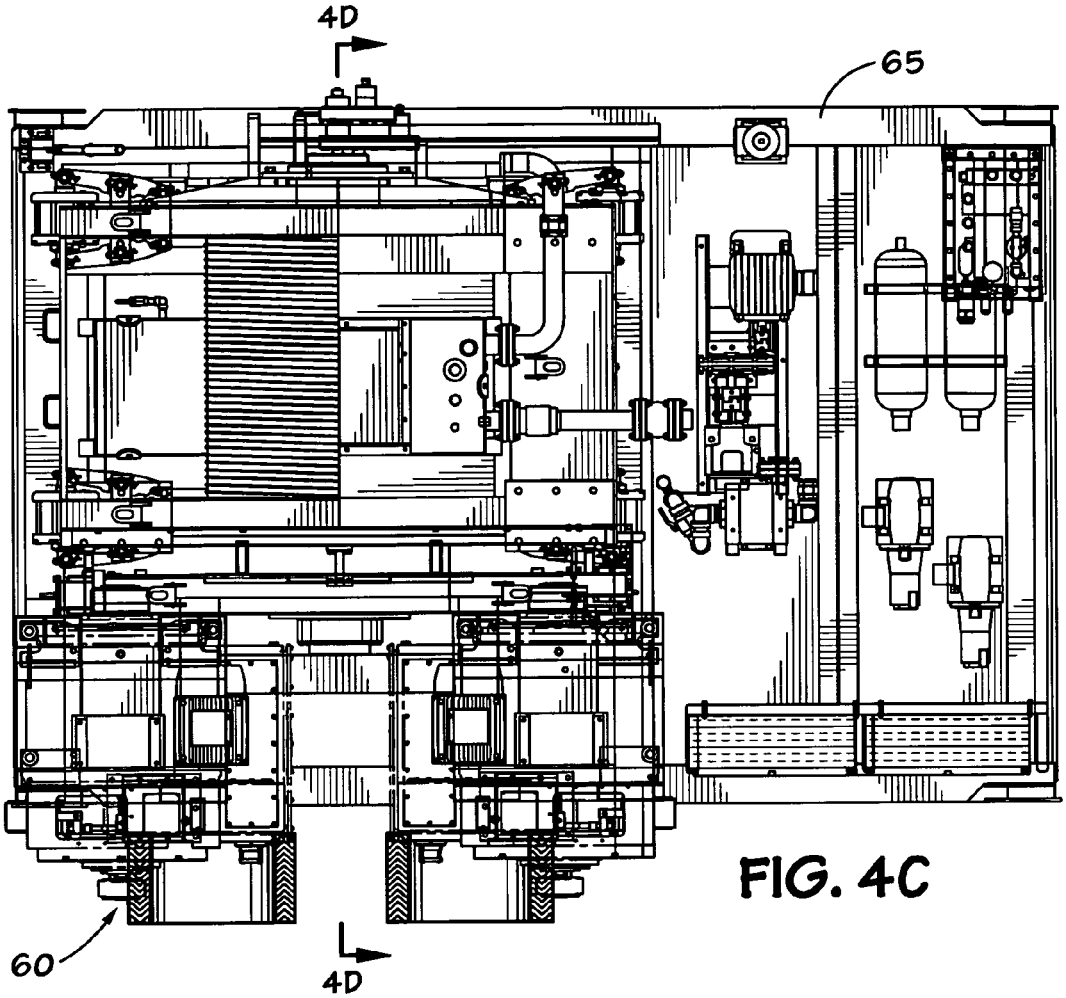
FIG. 4C
FIG. 4D
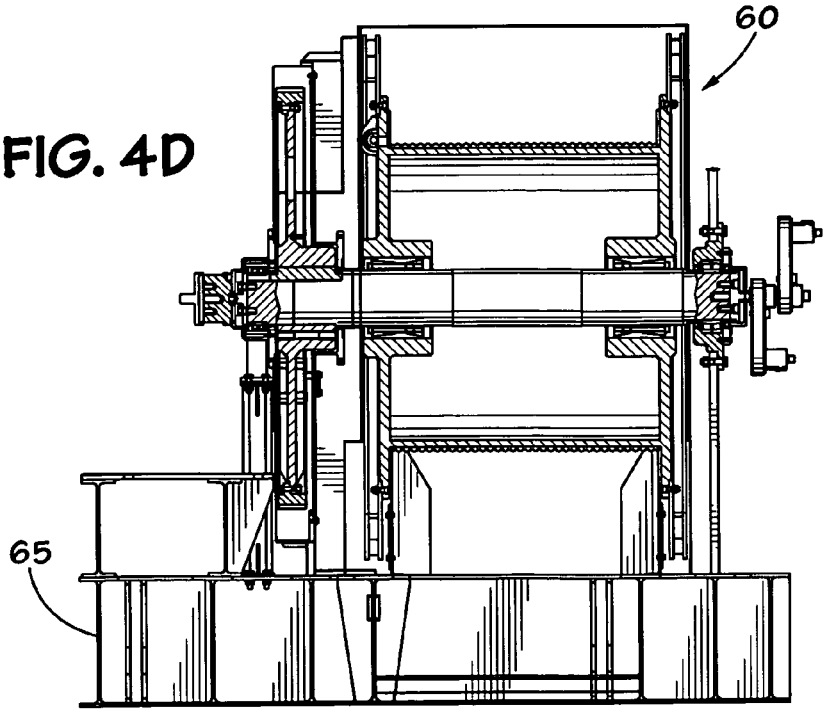

DRILLING RIG DRAWWORKS INSTALLATION

BACKGROUND OF THE INVENTION

1. Field of the Invention

This invention is directed to drilling rigs; drilling rigs with a drawworks; and to methods for installing a drawworks (or other equipment) on a rig.

2. Description of Related Art

The prior art discloses a variety of rigs used in drilling and various wellbore operations; for example, and not by way of limitation, U.S. Pat. Nos. 3,340,938; 3,807,109; 3,922,825; 3,942,593; 4,269,395; 4,290,495; 4,368,602; 4,489,526; 4,569,168; 4,837,992; 6,634,436; 6,523,319; and 7,306,055 and the references cited in these patents—all these patents incorporated fully herein for all purposes. The prior art discloses a variety of systems and methods for assembling and raising components of a drilling rig; for example, and not by way of limitation nor as an exhaustive listing, the disclosures in U.S. Pat. Nos. 2,993,570; 3,201,091; 3,262,237; 3,749,183; 4,221,088; 4,269,009; 4,292,772; 4,305,237; 4,478,015; 4,587,778; 4,630,425; and 4,932,175.

Often drilling rigs and related systems, equipment, and apparatuses are delivered to a site, assembled, raised, disassembled, and transported to a new site. It is important that drilling rigs and their components be easily transported, assembled, and installed.

Often rig components such as a drawworks (or other equipment) are raised by a crane, positioned on a rig's drill floor, and then secured to the drill floor. Various problems and disadvantages are associated with a drawworks installation that requires using a crane.

BRIEF SUMMARY OF THE INVENTION

The present invention, in certain aspects, provides a drilling rig with a drawworks (or other equipment or apparatuses) and methods for installing a drawworks (or other equipment or apparatuses) on a drilling rig without using a crane.

The present invention, in certain aspects, provides a drilling rig with a drawworks (or other equipment or apparatuses) and methods for installing a drawworks (or other equipment or apparatuses) on a drilling rig using a vehicle to move the drawworks adjacent the rig and then connecting the drawworks (or other equipment or apparatuses) to the rig.

In certain aspects, the present invention discloses methods and systems for installing a drawworks (or other equipment or apparatuses) on a drilling rig, the method, in certain aspects, including moving a drawworks on movement apparatus on the ground adjacent a drill floor of a rig, connecting the drawworks to the drill floor, moving the movement apparatus away from the rig, and raising the drill floor with the drawworks thereon using raising apparatus of a rig substructure supporting the drill floor Accordingly, the present invention includes features and advantages which are believed to enable it to advance drilling rig technology and equipment apparatus, and drawworks installation technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, non-obvious drilling rigs; drawworks installation methods; and new, useful, unique, efficient, nonobvious drawworks installation apparatus and methods; and Such systems and methods that include moving a drawworks on movement apparatus (e.g., but not limited to, a drawworks on a trailer pulled by a truck) on the ground adjacent a drill floor of a rig and installing the drawworks on the drill floor without the use of a crane or cables.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 1D is an end view partially cut-away of the drawworks of FIG. 1A.

FIG. 1E is an enlarged view of part of the drawworks as shown in FIG. 1D.

FIG. 1F is a side view of a lower skid of the drawworks of FIG. 1A.

FIG. 1G is a top view of the lower skid of FIG. 1F.

FIG. 2A is a side view illustrating a step in a method according to the present invention for installing a drawworks on a rig.

FIG. 2B is a side view illustrating a step following the step FIG. 2A.

FIG. 2C is an enlarged view of part of the drawworks shown in FIG. 2B.

FIG. 2D is a top view of the step of FIG. 2B.

FIG. 2O is a side view illustrating a step in the method according to the present invention following the step of FIG. 2N.

FIG. 4A is a side view of a drawworks according to the present invention.

FIG. 4B is an end view of the drawworks of FIG. 4A.

FIG. 4C is a top view of the drawworks of FIG. 4A.

FIG. 4D is a cross-section view along line 4D-4D of FIG. 4C.

Figure 1A:
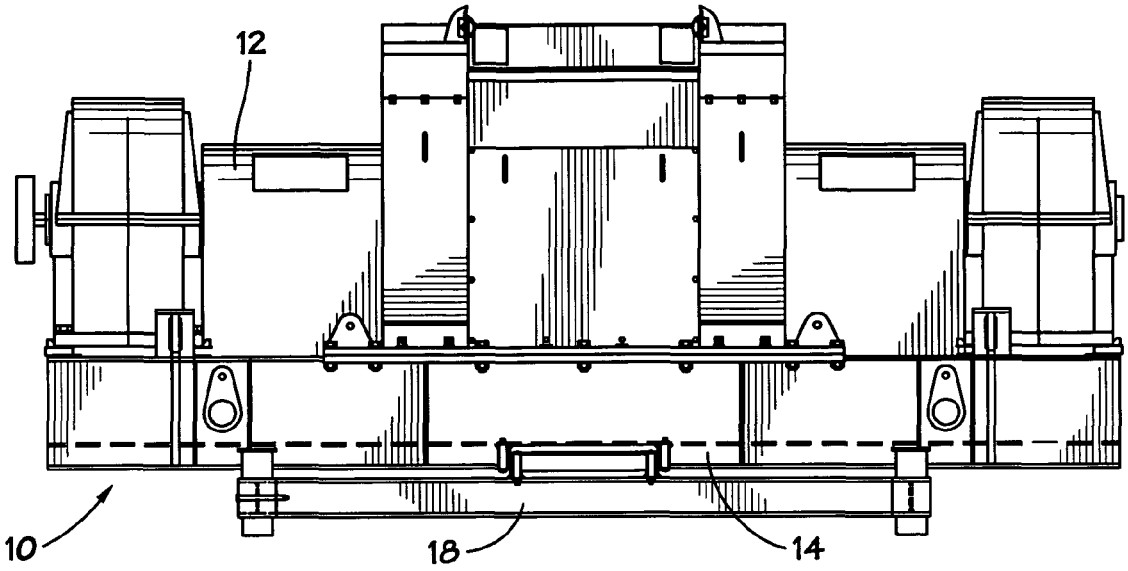
FIG. 1A is a side view of a drawworks according to the present invention.
Figure 1B:
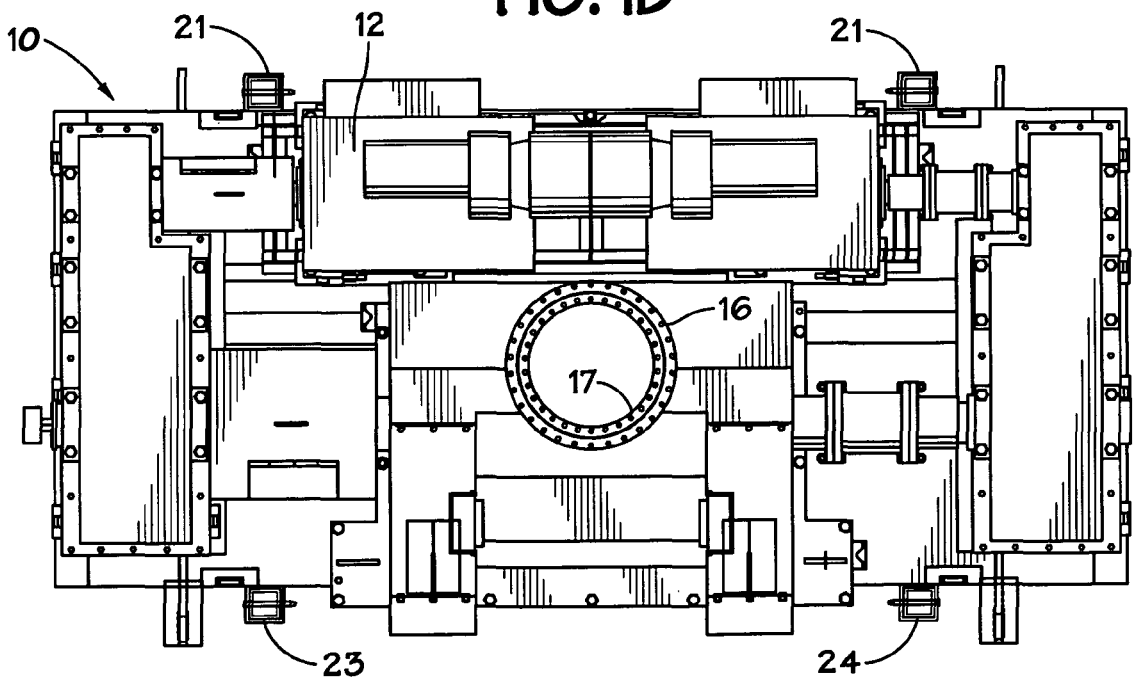
FIG. 1B is a bottom view of the drawworks of FIG. 1A.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness. [i. As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIGS. 1A and 1D show a drawworks 10 according to the present invention. The drawworks 10 has a housing 12 on an upper skid 14. The upper skid 14 has an upper bearing 16 which is rotatable around a lower bearing 17. The lower bearing 17 supports the upper skid 14. The lower bearing 17 is mounted on a lower skid 18. The upper skid 14 is rotatable on the lower bearing 17 to rotate the drawworks 10. It is to be understood that it is within the scope of the present invention to move, lift, and connect any equipment (to include apparatuses, systems, devices, or a rig structure) with systems and method according to the present invention.

Figure 1C:
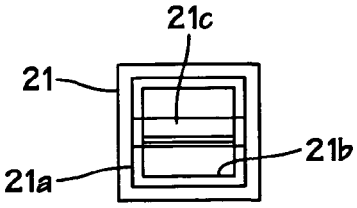
FIG. 1C is a cross-section view of a telescoping beam of the drawworks of FIG. 1A.

Connected to the lower skid 18 are four telescoping beams 21, 22, 23, 24 each with an inner beam part that can be released and extended. FIG. 1C shows the beam 21 with a pin hole 21*c*, an outer beam part 21*a* and an inner beam part 21*b*. For transport, e.g. on a trailer, the inner beam parts are extended so that the drawworks does not rotate.

Figure 2E:
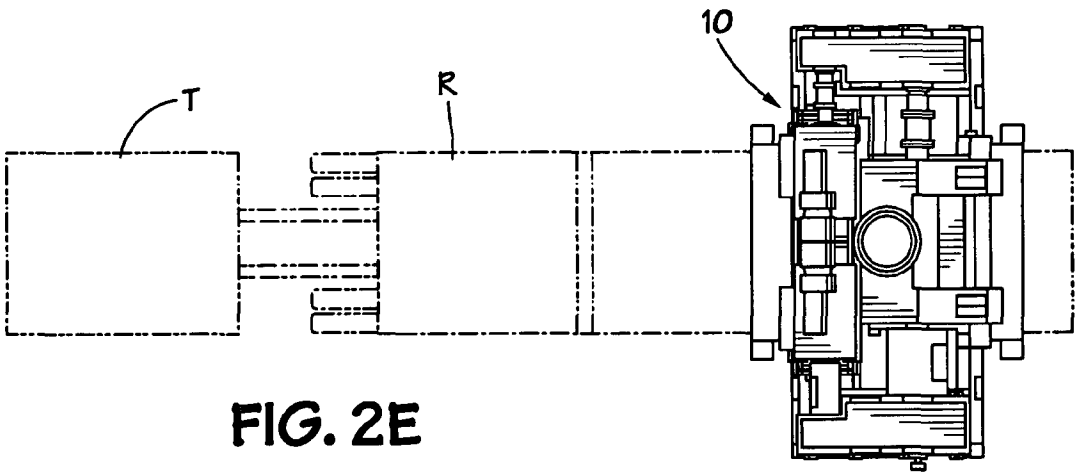
FIG. 2E is a top view illustrating a step in the method according to the present invention following the step of FIG. 2B.

FIGS. 2A-2C illustrate steps in a method according to the present invention with a drawworks 10. As shown in FIG. 2A the drawworks 10 is supported on a movement apparatus movable on the ground G such as a trailer R pulled by a truck T. During transport the four telescoping beams 21-24 are extended. Upon arrival near a rig 20, the telescoping beams 21-24 are raised and pinned in place with pins 25 (FIG. 2C). The drawworks 10 is rotated with the bearings 16, 17 ninety degrees (or any desired angle) (see FIG. 2E). The telescoping beams 21-24 are then extended (as in FIG. 2F).

Figure 2F:
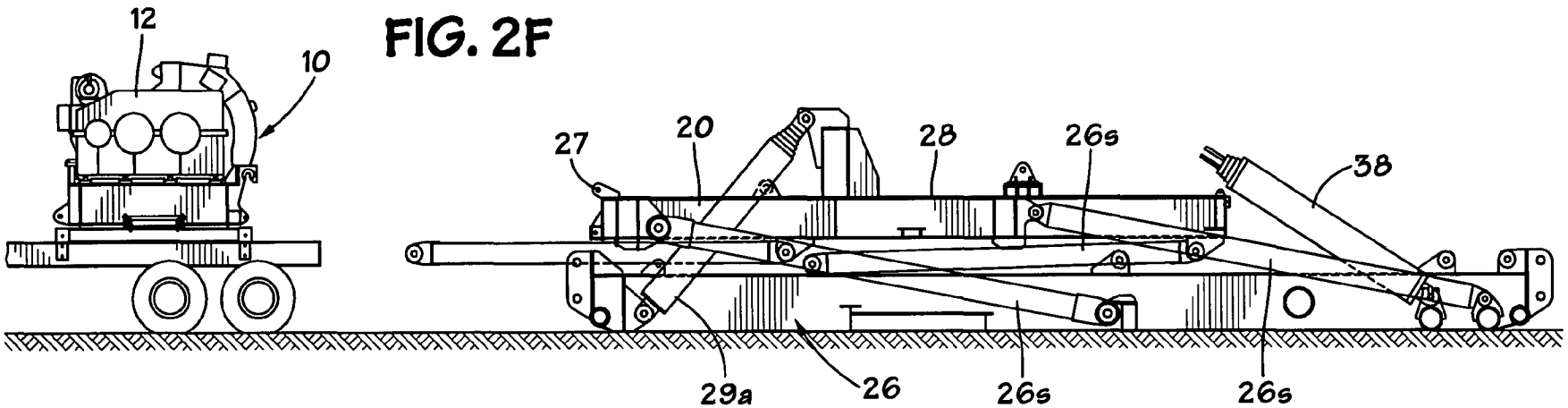
FIG. 2F is a side view illustrating the step of FIG. 2E.
Figure 2H:
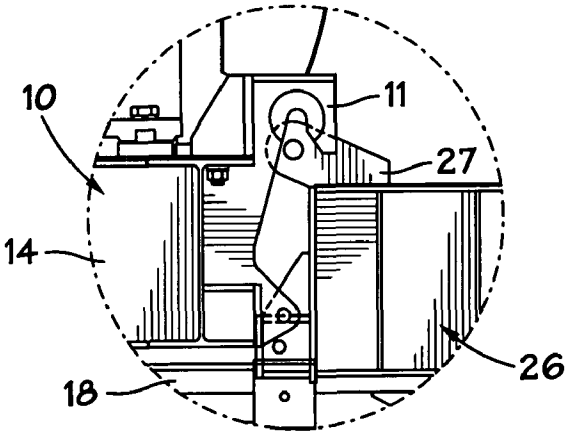
FIG. 2H is an enlargement of part of FIG. 2I.
Figure 2G:
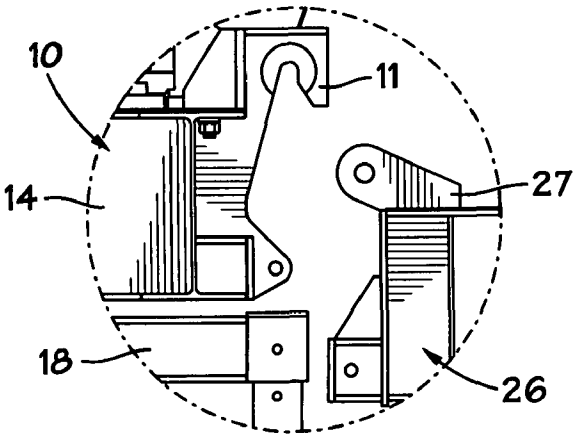
FIG. 2G is an enlarged side view showing the relationship of the drawworks of FIG. 2A moved toward the substructure of FIG. 2F.
Figure 2I:
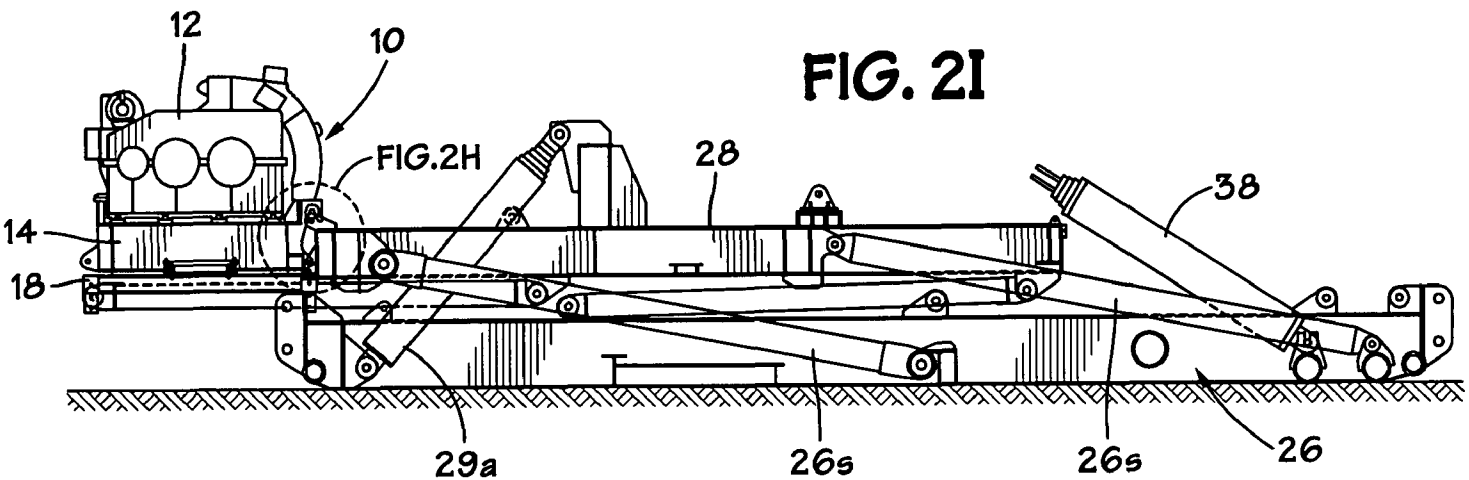
FIG. 2I is a side view illustrating a step in the method according to the present invention following the step of FIG. 2F.

As shown in FIG. 2F, the truck T backs up the trailer R to the rig 20. The rig 20 has a drill floor 28 and a substructure 26 with pivotable supports 26*s* that supports and are selectively raised and lowered with the drill floor 28. The trailer R is backed up so that the drawworks 10 is almost flush with the drill floor 28. Using powered hydraulic cylinder apparatuses 29*a* of the substructure 26, the substructure 26 is raised (see FIG. 2G) until a pin connection 27 of the substructure 26 is received and held in the hook connection 11 of the drawworks 10 (see FIGS. 2G, 2H, 2I). Then, the drawworks is lifted off the truck by the substructure 26 (FIG. 2K).

Figure 2J:
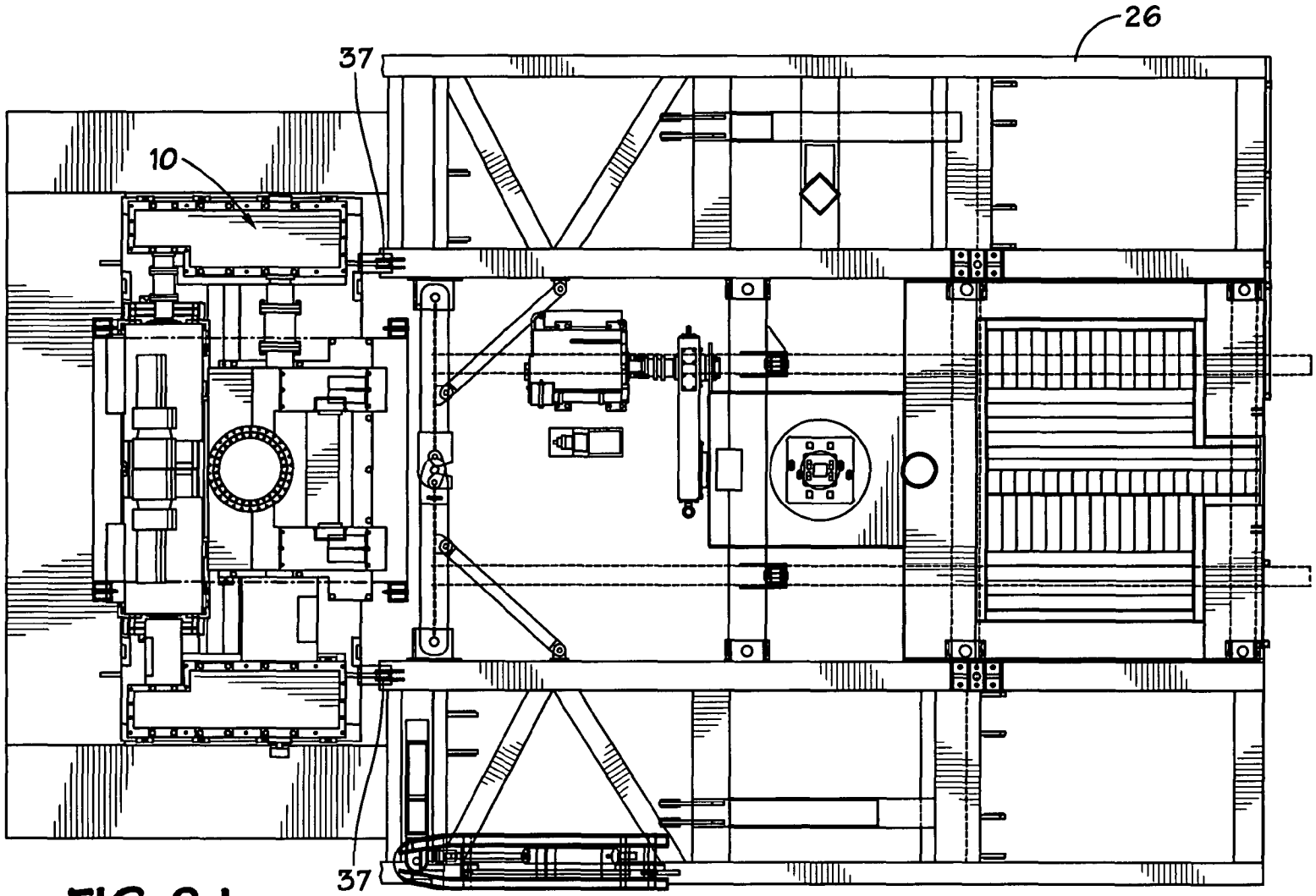
FIG. 2J is a top view of the step of FIG. 2I.
Figure 2K:
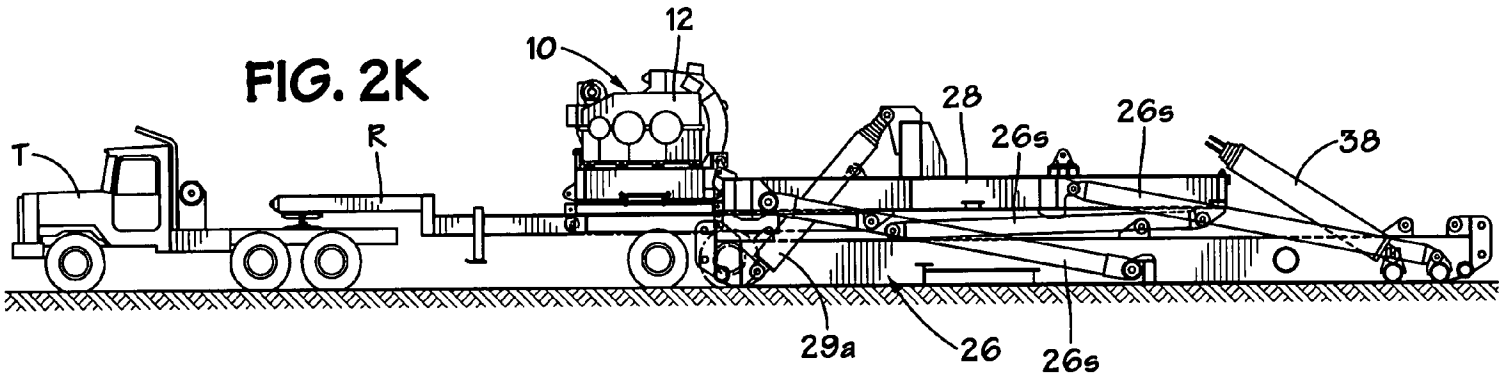
FIG. 2K is a side view illustrating a step in the method according to the present invention following the step of FIG. 2I.
Figure 2L:
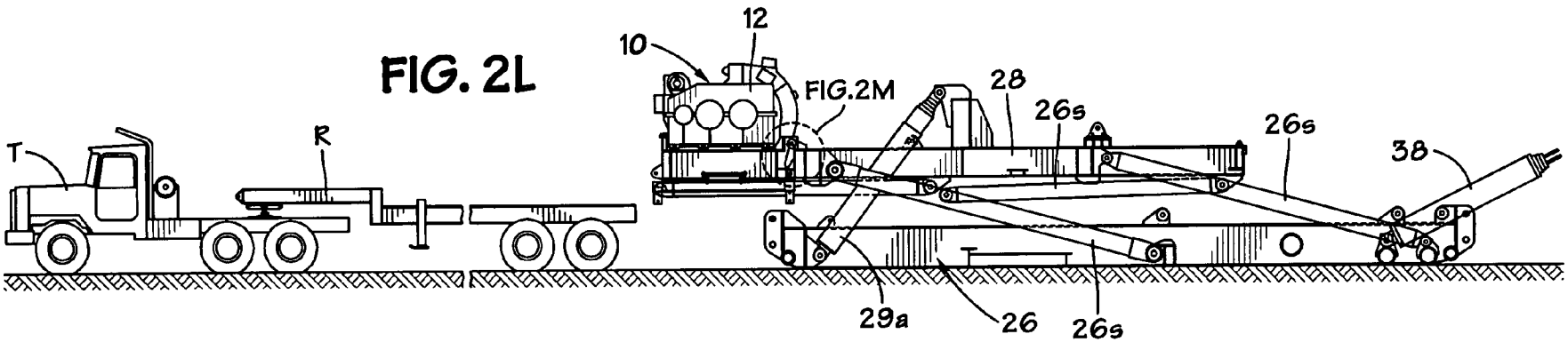
FIG. 2L is a side view illustrating a step in the method according to the present invention following the step of FIG. 2K.
Figure 2M:
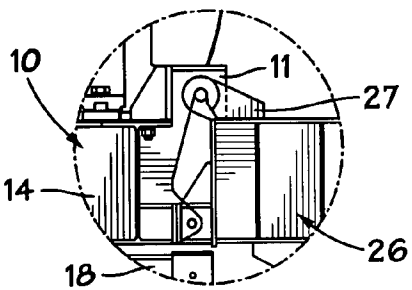
FIG. 2M is an enlarged view of part of the rig shown in the step of FIG. 2L.
Figure 2N:
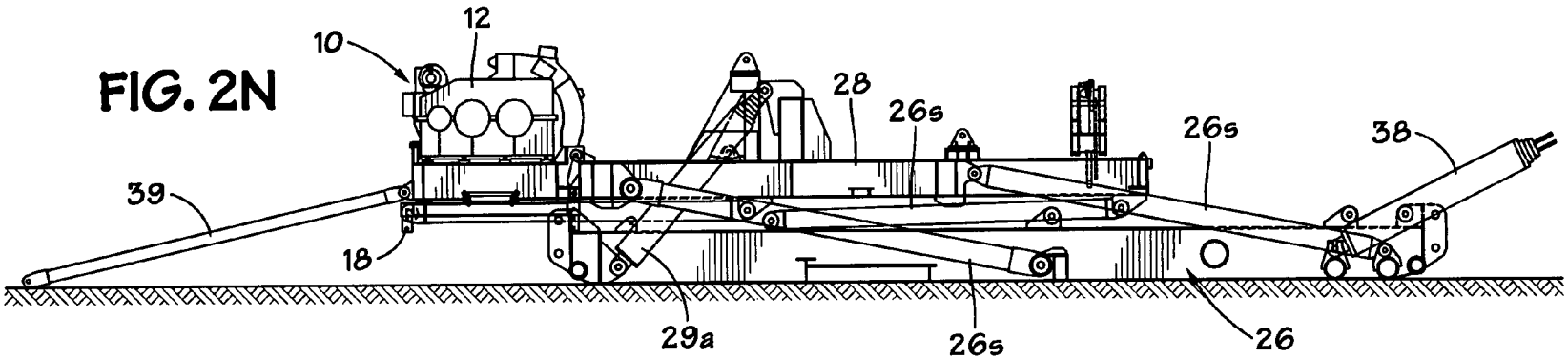
FIG. 2N is a side view illustrating a step in the method according to the present invention following the step of FIG. 2L.
Figure 20:
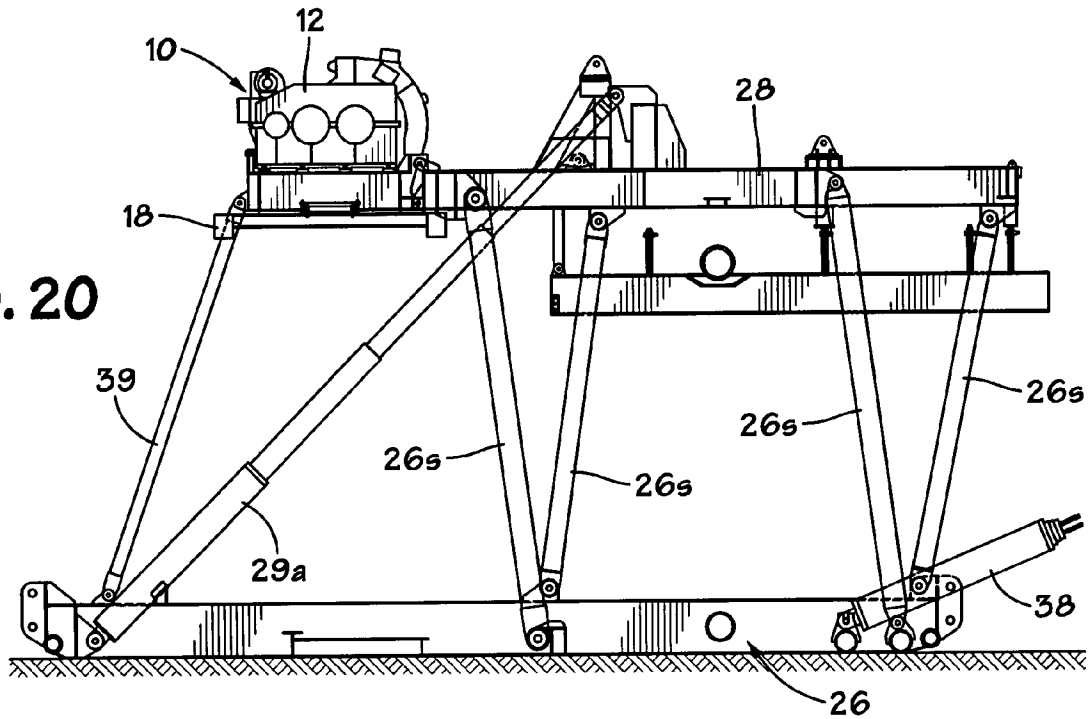

As shown in FIGS. 2J and 2K, the substructure 26 is lowered so that pins 37 (one on each side) pin together the drawworks 10 and the substructure 26. The truck T then moves away with the trailer R (see FIG. 2L). Support legs 39 are connected to the lower skid 18 of the drawworks (see FIG. 2N).

As shown in FIG. 2O, the substructure 26 raises the drill floor 28 with the drawworks 10 to a final desired height.

A mast raising cylinder apparatus 38 is used to raise a mast (not shown). In one aspect, the mast is as in the U.S. patent application entitled DRILLING RIG MASTS AND METHODS OF ASSEMBLY, co-owned with the present invention, filed on even date with the application for this patent, and fully incorporated herein for all purposes. The legs 39 are pinned in place to the bottom of the substructure 26.

FIGS. 3A-3J illustrate a method according to the present invention using hook-connection/pin-connection connectors as described above and a telescoping beam extendable from a rig substructure to connect to a drawworks and cantilever a drawworks from a movement support such as a trailer pulled by a truck.

Figure 3A:
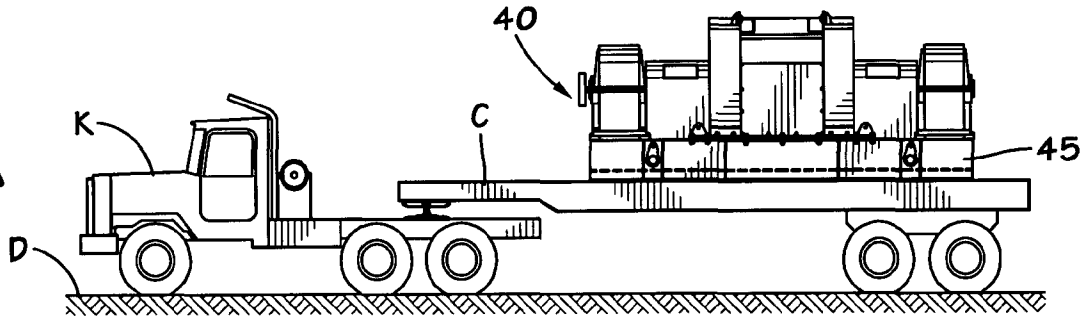
FIG. 3A is a side view illustrating a step in a method according to the present invention for installing a drawworks on a rig.

As shown in FIG. 3A a truck K on the ground D has a trailer C attached thereto with a drawworks 40 on a skid 45 supported on the trailer C. The drawworks 40 has two hook structures 41 with hooks 41*a* (see FIG. 3E). A substructure 56 has pin connection structures 57 with connection pins 57*a* (see FIG. 3E) on each of two telescoping beams 52 (one shown, FIG. 3C; the other opposite and spaced-apart from the one shown on the other side of the substructure). The substructure 56 raises and lowers a drill floor 58. The substructure includes a plurality of pivotably connected supports 56*s* and a substructure raising cylinder assembly 56*c*.

Figure 3B:
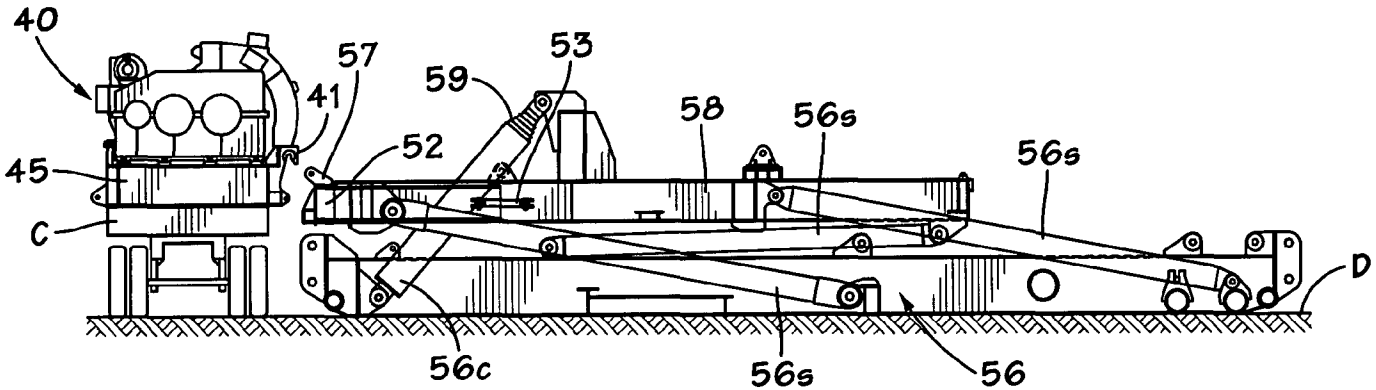
FIG. 3B is a side view illustrating a step following the step FIG. 3A.
Figure 3C:
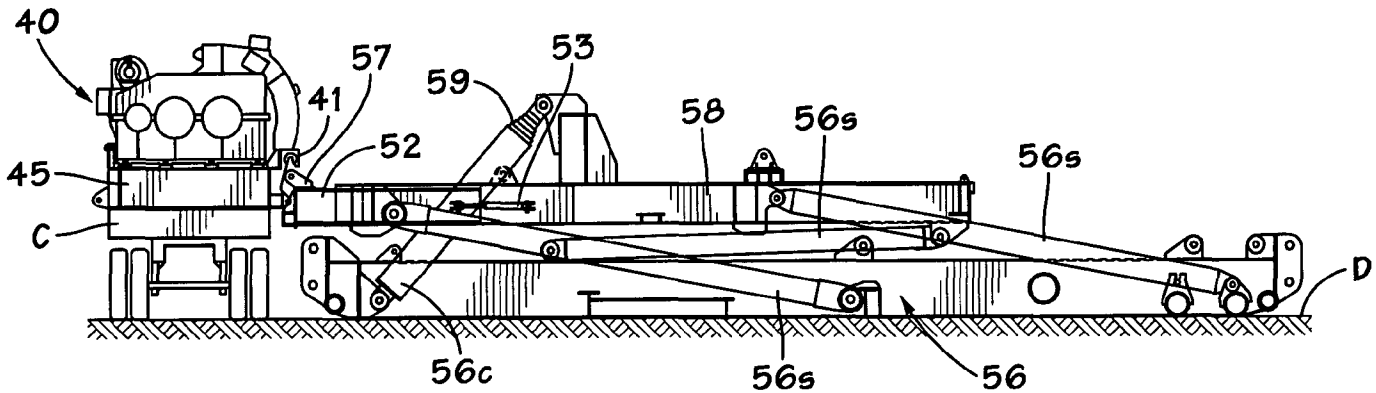
FIG. 3C is a side view illustrating a step following the step FIG. 3B.

The truck K moves the drawworks 40 alongside the drill floor 58 (FIG. 3B). Parts 52*a* of the beams 52 are extended for engagement with the hook structures 41 of the drawworks 40. Hydraulic cylinder apparatuses 53 are used to extend the beam parts 52*a*.

Figure 3D:
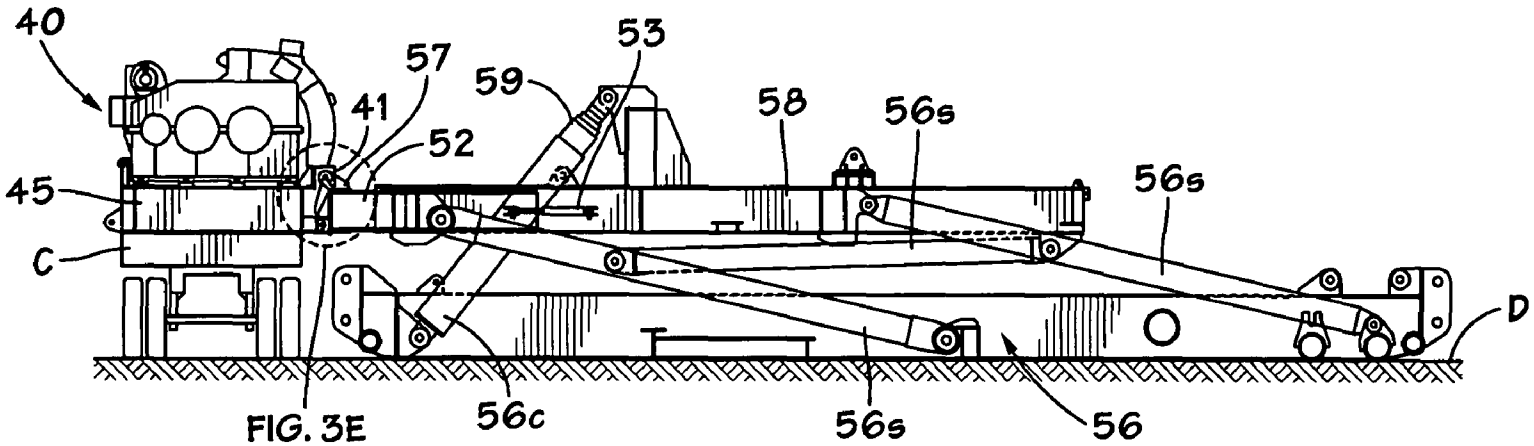
FIG. 3D is a side view illustrating a step following the step FIG. 3C.
Figure 3E:
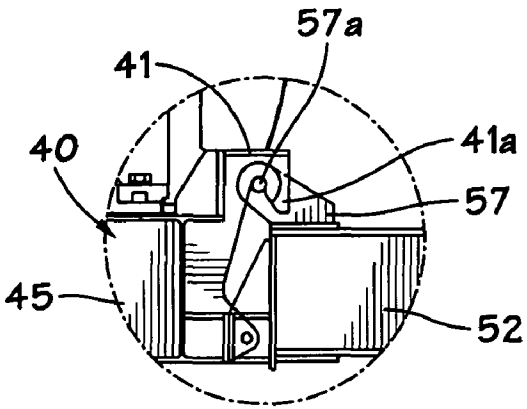
FIG. 3E is an enlarged view showing a connection as shown in FIG. 3D.

As shown in FIG. 3D, the substructure 56 is raised by the substructure raising cylinder assembly 56*c* until the pins 57*a* of the pin connection structures 57 are moved into the hooks 41*a* of the hook structures 41.

Figure 3F:
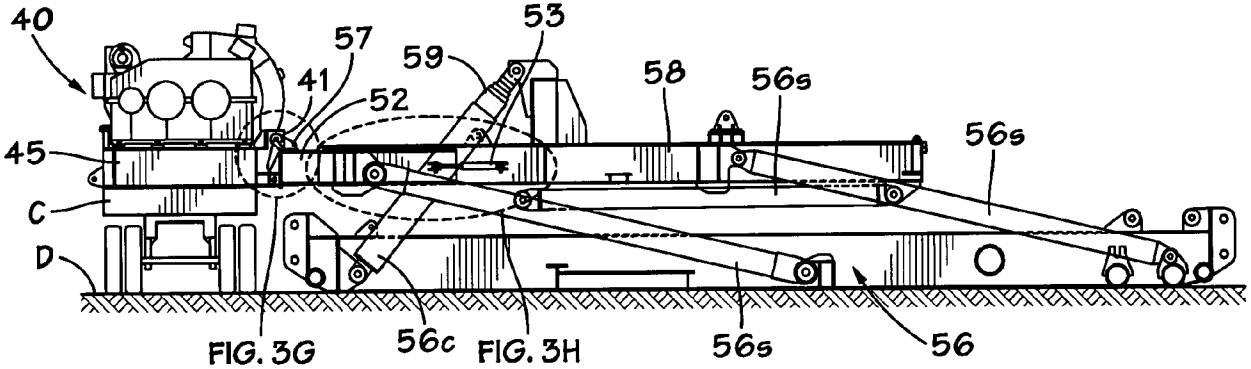
FIG. 3F is a side view illustrating a step following the step FIG. 3D.
Figure 3H:
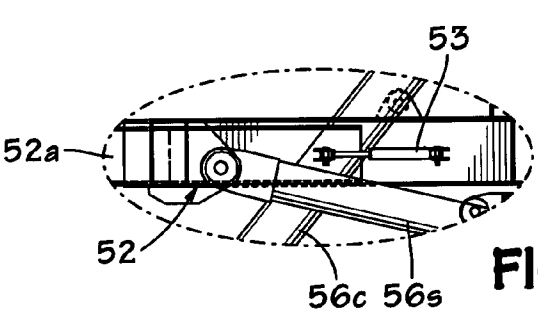
FIG. 3H is an enlarged view of part of FIG. 3F.
Figure 3G:
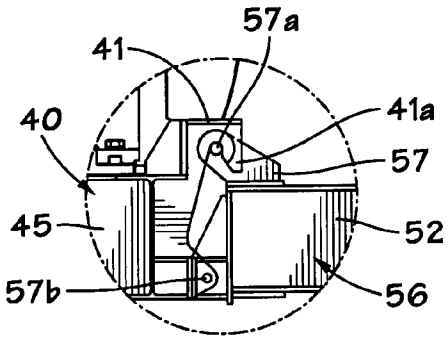
FIG. 3G is an enlarged view of part of the drawworks shown in FIG. 3F.
Figure 3I:
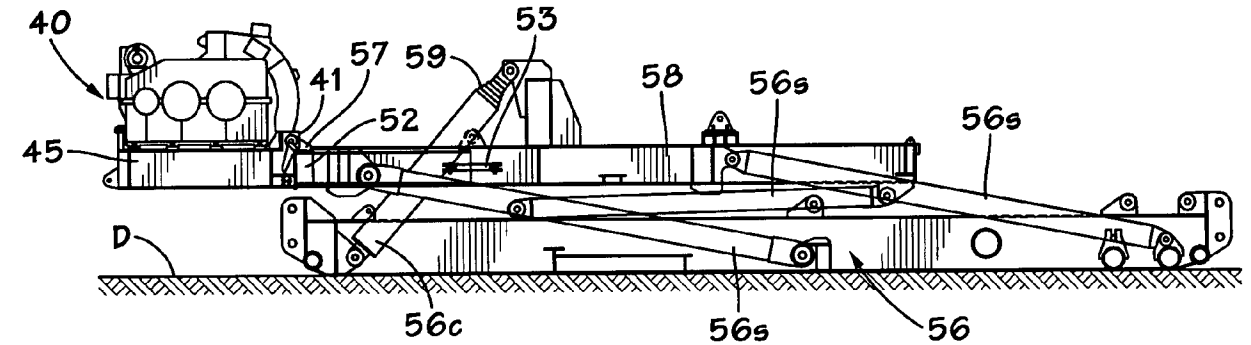
FIG. 3I is a side view illustrating a step following the step of FIG. 3F.

As shown in FIG. 3F, the substructure 56 is then lowered and pins 57*b* are inserted into holes in the substructure 56 and holes in the drawworks 40 to pin the substructure 56 to the drawworks 40 (FIG. 3G). To insure that the top of the skid 45 is level with the drill floor 58, the substructure 56 is lowered an appropriate amount. As shown in FIG. 3I, the telescoping beams 52 are retracted by the powered cylinder apparatus 53, bringing the skid 45 flush with the drill floor 58. Once the substructure 56 is connected to the drawworks 40, the substructure 56 is raised to lift the drawworks 40 off the trailer C and the truck K and trailer C are moved away.

Figure 3J:
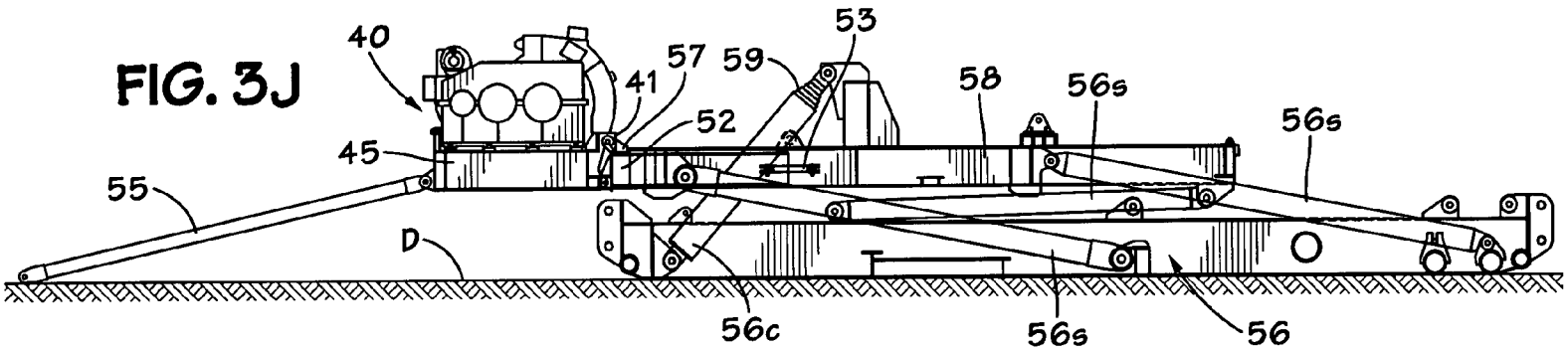
FIG. 3J is a side view illustrating a step following the step FIG. 3I.
Figure 3K:
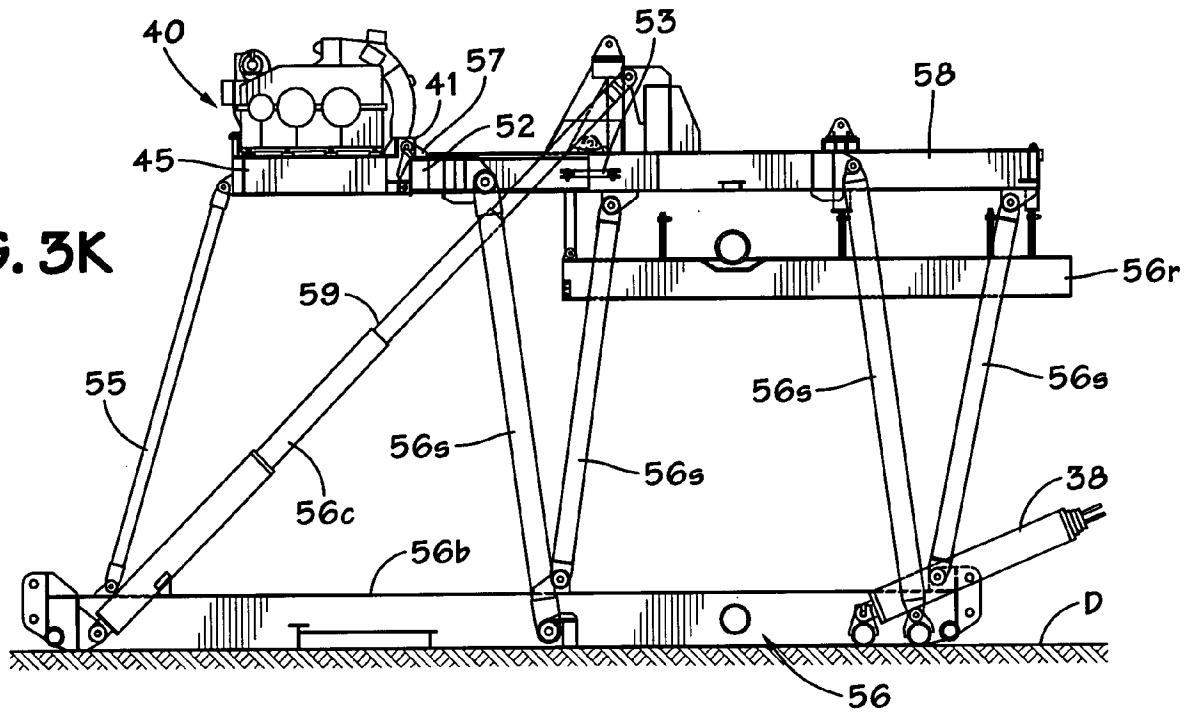
FIG. 3K is a side view illustrating a step following the step FIG. 3J.

The substructure 56 with the drawworks 40 secured thereto is then lowered so that two support legs 55 (one shown in the view in FIGS. 3J, 3K; another not shown spaced-apart from and parallel to the one shown) can be connected to the drawworks skid 45 (FIG. 3J). With the legs 55 connected, the substructure 56 raises the drill floor 58 in the drawworks 40 to a working height (FIG. 3K). Lower ends of the legs 55 are connected to a base 56*b* of the substructure 56. A BOP beam 56*r* is connected to the substructure.

FIGS. 5A-5H illustrate a method according to the present invention for installing a drawworks 60 (see FIGS. 4A-4D) on a drill floor 78 of a substructure 76. The drawworks 60 is on a skid 65 and, initially, is supported on a trailer F pulled by a truck V on ground N. The substructure 76 has a base 76*b* to which are connected powered hydraulic cylinder apparatuses 79*a*, a mast raising cylinder apparatus 79*b*, and a plurality of pivotable supports 76*s* which support a drill floor 78. Bottom ends of the apparatuses 79*a* and 79*b*, and of the supports 76*s* are pivotably connected to the base 76*b*. Top ends of the apparatus 79*a* and supports 76*s* are pivotably connected to the drill floor 78. Pins 77 (as discussed below) are used to pin the drawworks skid 65 to the substructure's drill floor 78. The drill floor 78 has an open space 78*s* into which a drawworks can be moved and into which a vehicle, e.g. a truck/trailer combination, can move e.g. to move a drawworks into place or any other equipment, structure apparatus, or device.

Figure 5A:
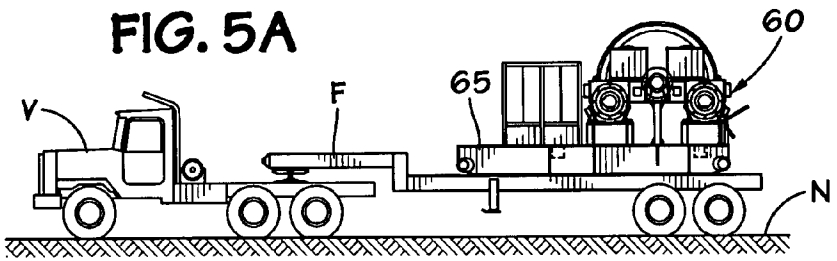
FIG. 5A is a side view illustrating a step in a method according to the present invention for installing a drawworks on a rig.
Figure 5B:
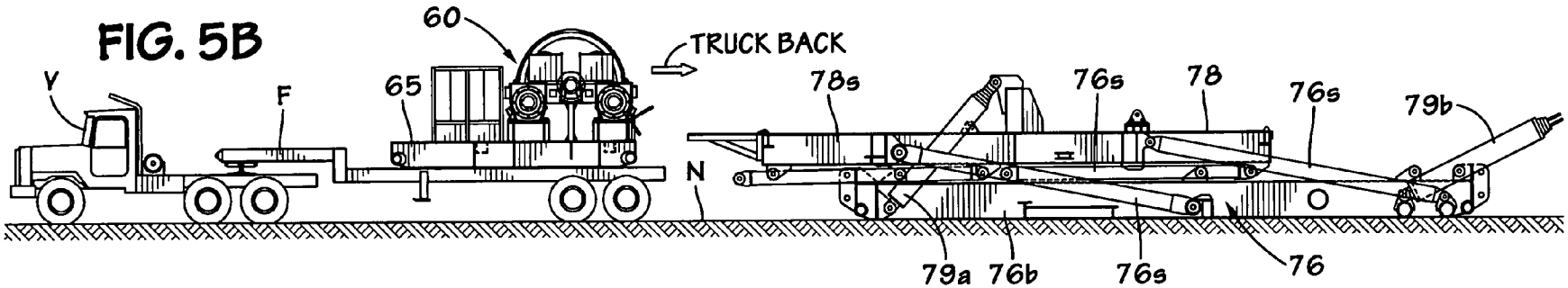
FIG. 5B is a side view illustrating a step following the step FIG. 5A.
Figure 5C:
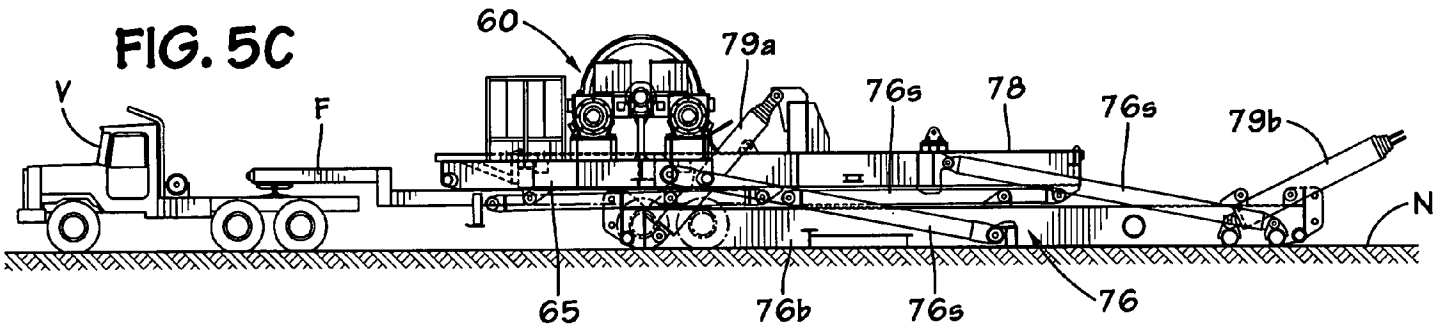
FIG. 5C is a side view of part of the drawworks shown in FIG. 5B.
Figure 5D:
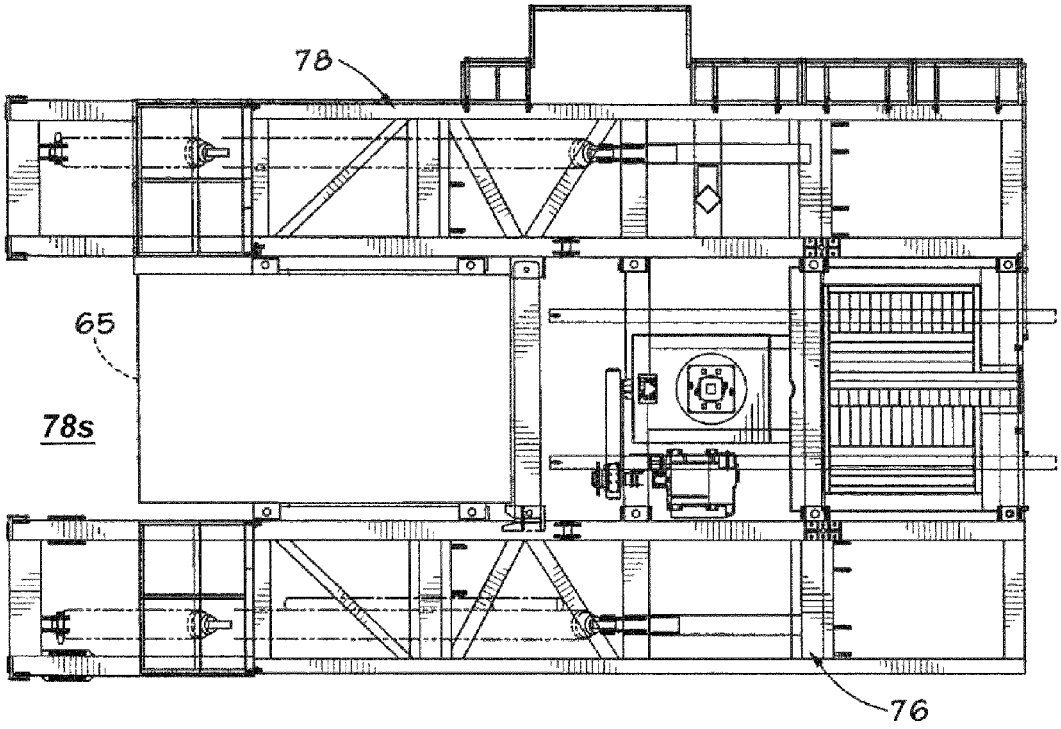
FIG. 5D is a top view of some of the structure shown in FIG. 5C.
Figure 5E:
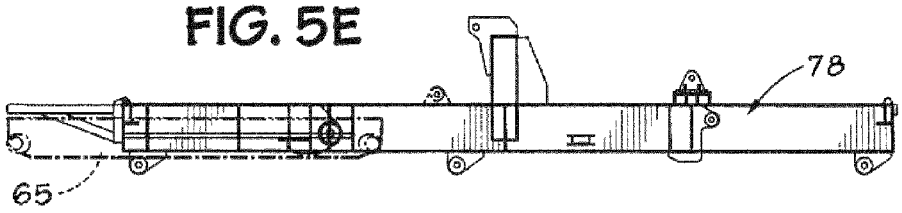
FIG. 5E is a partial side view of the structure shown in FIG. 5D.
Figure 5F:
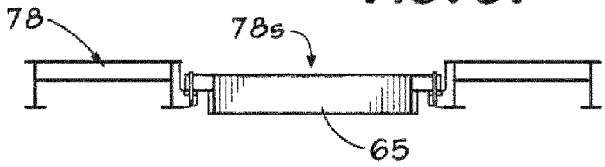
FIG. 5F is an end view of part of the structure shown in FIG. 5D.
Figure 5G:
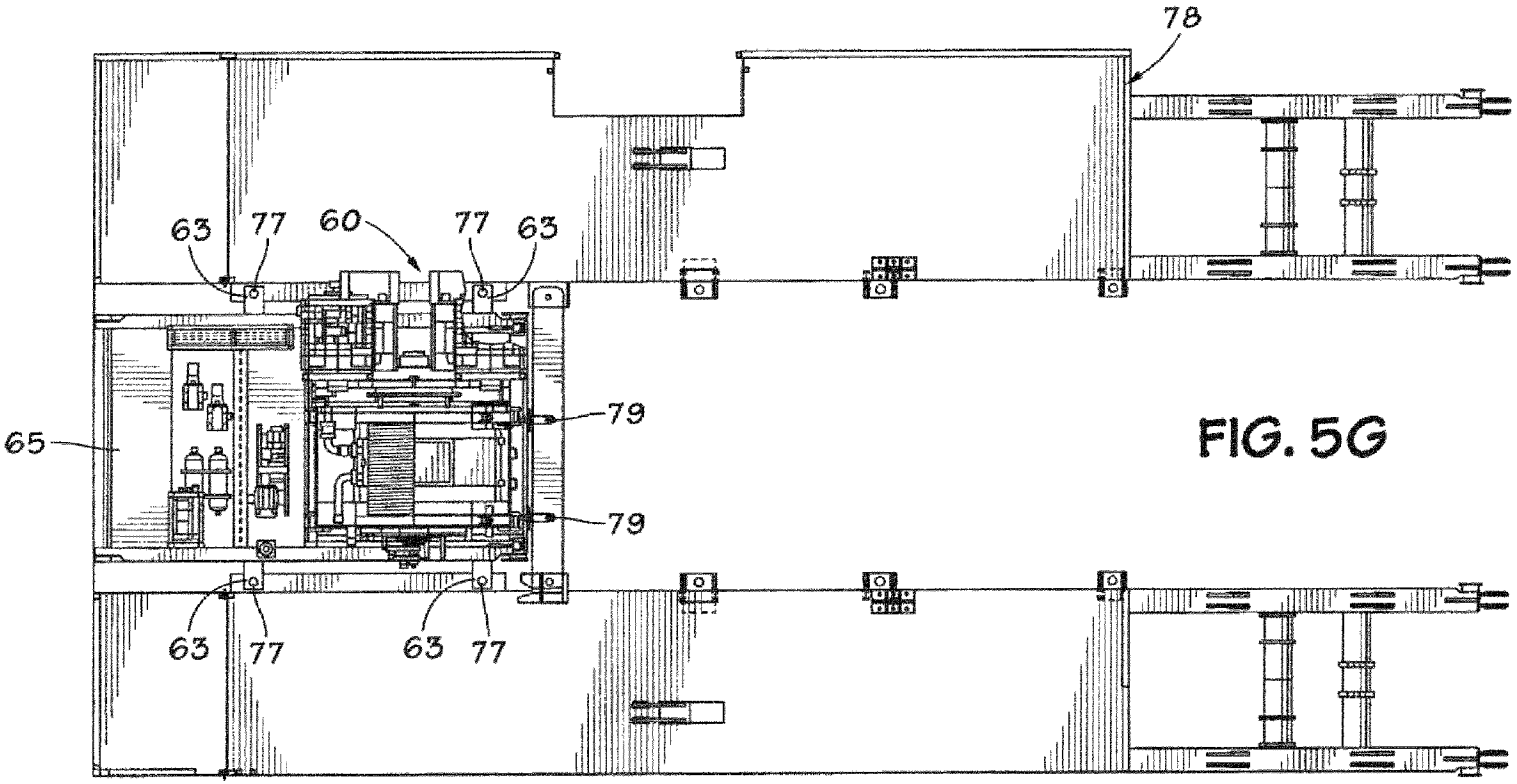
FIG. 5G is a top view of the substructure shown in FIG. 5C.
Figure 5I:
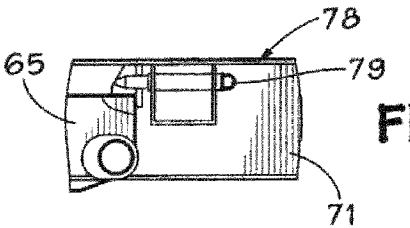
FIG. 5I is a cross-section view along line 5I-5I of FIG. 5G.
Figure 5H:
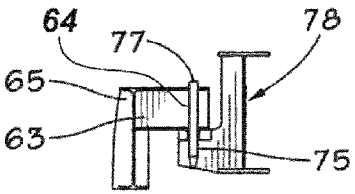
FIG. 5H is a cross-section view along line 5H-5H of FIG. 5G.
Figure 5J:
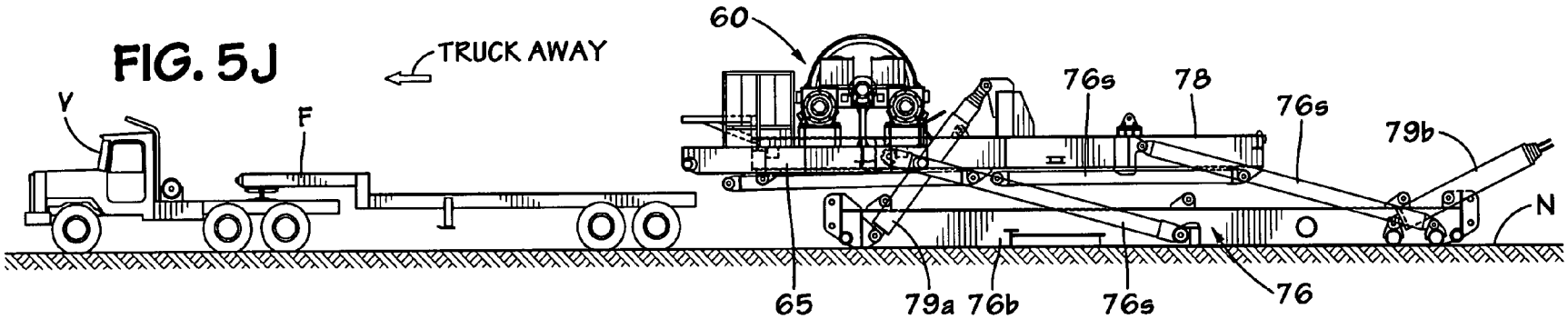
FIG. 5J is a side view illustrating a step following the step of FIG. 5G.

As shown in FIGS. 5A, 5B, and 5C the truck V moves the drawworks 60 adjacent the substructure 76 and into the space 78*s* in the drill floor 78. With the drawworks 60 in position, pins 77 are inserted through holes 64 in four drawworks lugs 63 and into Corresponding holes 75 in the drill floor 78, as shown in FIGS. 5G-5H. Lock pins 79 are installed through a beam 71 of the drill floor 78 into the skid 65. Upon securement of the drawworks 60 to the drill floor 78 (and release from the trailer F), the truck V and trailer F are moved away (FIG. 5J).

Figure 5K:
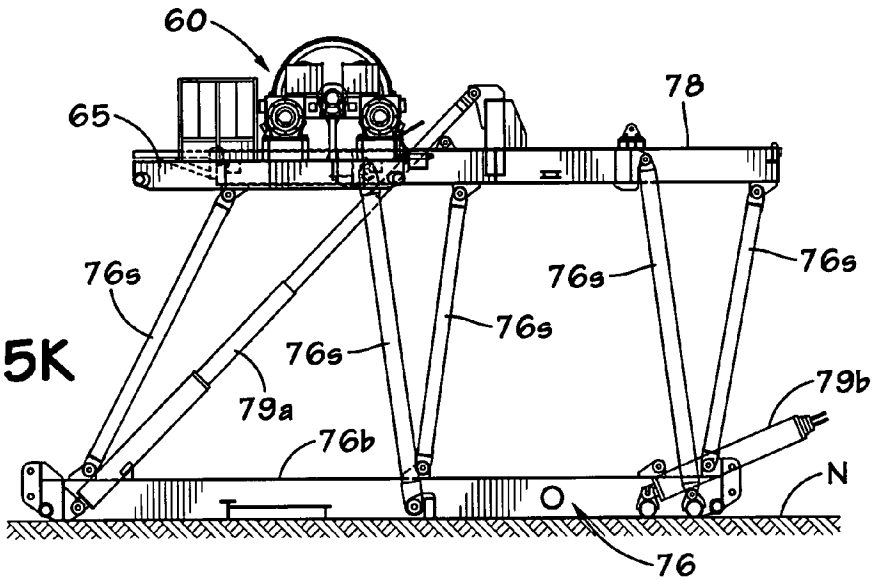
FIG. 5K is a side view illustrating a step following the step of FIG. 5G.

The cylinder apparatus 79*a* (one shown in FIGS. 5B and 5K; another not shown spaced-apart from and parallel to the one shown) then raises the drill floor 78 with the drawworks 60. No crane is used to install the drawworks 60, no cables are connected and winched upwardly for the installation, and the size of the drill floor 78 can be reduced since the drawworks 60 is integrated into and connected to an end of the drill floor 78; the skid 65 continues to support the drawworks following connection to the drill floor 78, and no part of the drill floor is needed beneath the skid 65 for this support.

The present invention, therefore, provides in some, but not in necessarily all, embodiments methods for installing a drawworks (or other rig apparatus, e.g. equipment, device, system, apparatuses) on a drilling rig, the methods including: moving a drawworks on movement apparatus on the ground adjacent a drill floor of a rig, the rig having a substructure and raising apparatus on the substructure; connecting the drawworks to the drill floor; and raising the drill floor with the drawworks thereon using the raising apparatus of the rig substructure. Such methods may one or some, in any possible combination, of the following: the drawworks is rotatably mounted on the movement apparatus, the method including rotating the drawworks with respect to the movement apparatus prior to connecting the drawworks to the drill floor; the drawworks having drawworks connection apparatus and the drill floor has drill floor connector structure, the method further including raising the drill floor to connectingly engage the drill floor connector structure with the drawworks connection apparatus to connect the drawworks to the drill floor; moving the movement apparatus away from the rig; wherein a securement device secures the drawworks to the drill floor, the method further including securing the drawworks to the drill floor with the securement device; raising the drill floor with the drawworks thereon to a desired operational height; wherein the drill floor has an interior open space into which a movement apparatus is selectively movable with the drawworks thereon, the method further including moving the drawworks into the interior open space of the drill floor on the movement apparatus prior to connecting the drawworks to the drill floor; wherein the movement apparatus is a truck-trailer combination with the drawworks on a trailer of the truck-trailer combination, the trailer connected to and movable by a truck of the truck-trailer combination; the drawworks connection apparatus is hook apparatus for connection to a corresponding pin structure, and the drill floor connector structure includes a corresponding pin structure engagable by the hook apparatus; the drawworks is connected to a drawworks skid, the drawworks connection apparatus includes a plurality of lugs spaced-apart on and projecting from the skid, each lug having a lug hole, the drill floor connector structure including a drill floor hole in the drill floor corresponding to each lug hole, the method further including connecting the drawworks to the drill floor by emplacing a pin with respect to each lug hole and drill floor hole so that a first portion of the pin is in the lug hole and a second portion of the pin is in the drill floor hole; wherein the drawworks includes a skid, the method further including connecting the drawworks to the drill floor so that a top of the skid is substantially level with the drill floor; the substructure includes extension apparatus extendable to engage the drawworks, the method further including extending the substructure extension apparatus from the substructure, and engaging the drawworks with the substructure extension apparatus; and/or retracting the substructure extension apparatus while it is engaging the drawworks to move the drawworks to the drill floor.

The present invention, therefore, provides in some, but not in necessarily all, embodiments a method for installing a drawworks (or rig apparatus) on a drilling rig, the method including moving a drawworks on movement apparatus on the ground adjacent a drill floor of a rig, the rig having a substructure and raising apparatus on the substructure; connecting the drawworks to the drill floor; and raising the drill floor with the drawworks thereon using the raising apparatus of the rig substructure; wherein the drawworks has drawworks connection apparatus and the drill floor has drill floor connector structure, raising the drill floor to connectingly engage the drill floor connector structure with the drawworks connection apparatus to connect the drawworks to the drill floor, moving the movement apparatus away from the rig, wherein a securement device secures the drawworks to the drill floor, securing the drawworks to the drill floor with the securement device, raising the drill floor with the drawworks thereon to a desired operational height, and wherein the movement apparatus is a truck-trailer combination with the drawworks on a trailer of the truck-trailer combination, the trailer connected to and movable by a truck of the truck-trailer combination.

The present invention, therefore, provides in some, but not in necessarily all, embodiments a method for installing a drawworks on a drilling rig on ground, the method including: moving a drawworks on movement apparatus on ground adjacent a drill floor of a rig, the rig having a substructure and raising apparatus on the substructure; wherein the drill floor having an interior open space into which a movement apparatus is selectively movable with the drawworks thereon; moving the drawworks into the interior open space of the drill floor on the movement apparatus; and connecting the drawworks to the drill floor. Such a method may one or some, in any possible combination, of the following: raising the drill floor with the drawworks thereon using the raising apparatus of the rig substructure; the drawworks has drawworks connection apparatus and the drill floor has drill floor connector structure, the method further including raising the drill floor to connectingly engage the drill floor connector structure with the drawworks connection apparatus to connect the drawworks to the drill floor; wherein a securement device secures the drawworks to the drill floor, the method further including securing the drawworks to the drill floor with the securement device; and/or wherein the drawworks includes a skid, the method further including positioning the drawworks with respect to the drill floor so that a top of the skid is substantially level with the drill floor.

The present invention, therefore, provides in some, but not in necessarily all, embodiments a drill floor including the drill floor having a floor section with an interior open space into which a movement apparatus is selectively movable with a drawworks thereon, and drill floor connector structure on the drawworks for connection to corresponding connection structure on a drawworks, the drill floor connector structure movable to engage a drawworks connection apparatus to connect a drawworks to the drill floor.

The present invention, therefore, provides in some, but not in necessarily all, embodiments a method for installing a rig apparatus on a drilling rig, the method including: moving a rig apparatus on movement apparatus on the ground adjacent a drill floor of a rig, the rig having a substructure and raising apparatus on the substructure; connecting the rig apparatus to the drill floor; and raising the drill floor with the rig apparatus thereon using the raising apparatus of the rig substructure; wherein the rig apparatus has rig apparatus connection apparatus and the drill floor has drill floor connector structure; raising the drill floor to connectingly engage the drill floor connector structure with the rig apparatus connection apparatus to connect the rig apparatus to the drill floor; moving the movement apparatus away from the rig; wherein a securement device secures the rig apparatus to the drill floor; securing the rig apparatus to the drill floor with the securement device; raising the drill floor with the rig apparatus thereon to a desired operational height; and wherein the movement apparatus is a truck-trailer combination with the rig apparatus on a trailer of the truck-trailer combination, the trailer connected to and movable by a truck of the truck-trailer combination.

The systems and methods of the inventions described in the following pending U.S. patent applications, co-owned with the present invention, filed on even date herewith, naming Donnally et al as inventors, and fully incorporated herein for all purposes, may be used with certain embodiments of the present invention, the applications entitled: "Drilling Rig Masts And Methods Of Assembly and Erection"; "Drilling Rig Structure Installation And Methods"; and "Drilling Rigs and Erection Methods".

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are including, but items not specifically mentioned are not excluded. A reference to an element by the indefinite article "a" does not exclude the possibility that more than one of the element is present, unless the context clearly requires that there be one and only one of the elements.

What is claimed is:

1. A method for installing a drawworks on a drilling rig, comprising moving the drawworks on a movement apparatus on a surface adjacent to a drill floor of the drilling rig, the drilling rig having a substructure and raising apparatus on the substructure, connecting the drawworks to the drill floor, and raising the drill floor with the drawworks connected thereto using the raising apparatus.

2. The method of claim 1 further comprising rotatably mounting the drawworks on the movement apparatus, and rotating the drawworks with respect to the movement apparatus prior to connecting the drawworks to the drill floor.

3. The method of claim 1 wherein connecting the drawworks to the drill floor comprises raising the drill floor to connectingly engage a connector structure of the drill floor with a connection apparatus of the drawworks.

4. The method of claim 1 further comprising moving the movement apparatus away from the drilling rig.

5. The method of claim 3 further comprising securing the drawworks to the drill floor with a securement device.

6. The method of claim 5 further comprising raising the drill floor with the drawworks connected thereto to a desired operational height.

7. The method of claim 1 further comprising moving the drawworks into an interior open space of the drill floor on the movement apparatus prior to connecting the drawworks to the drill floor.

8. The method of claim 1 wherein moving the drawworks on the movement apparatus comprises positioning the drawworks on a trailer of a truck-trailer combination, the trailer connected to and movable by a truck of the truck-trailer combination.

9. The method of claim 3 wherein connectingly engaging the connector structure of the drill floor with the connection apparatus of the drawworks comprises engaging a pin structure of the connector structure with a hook apparatus of the connection apparatus.

10. The method of claim 3 further comprising connecting the drawworks to a drawworks skid comprising a plurality of spaced-apart lugs projecting therefrom, each lug having a lug hole, a drill floor hole in the drill floor, and wherein connecting the drawworks to the drill floor further comprises aligning the lug hole of each of the plurality of spaced-apart lugs with a corresponding drill floor hole in the drill floor and emplacing a pin with respect to each lug hole and each drill floor hole so that a first portion of each pin is in a respective lug hole and a second portion of each pin is in a respective drill floor hole.

11. The method of claim 1 further comprising connecting the drawworks to the drill floor so that a top of a skid comprising the drawworks is substantially level with the drill floor.

12. The method of claim 1 further comprising extending a substructure extension apparatus from the substructure, and engaging the drawworks with the substructure extension apparatus.

13. The method of claim 12 further comprising retracting the substructure extension apparatus while it is engaging the drawworks to move the drawworks to the drill floor.

14. A method for installing a drawworks on a drilling rig, comprising positioning the drawworks on a movement apparatus comprising a truck-trailer combination, wherein a trailer of the truck-trailer combination is connected to and moveable by a truck of the truck-trailer combination, moving the drawworks with the movement apparatus on a surface adjacent to a drill floor of the drilling rig, the drilling rig having a substructure and raising apparatus on the substructure, connecting the drawworks to the drill floor, by raising the drill floor with the drawworks connected thereto using the raising apparatus and connectingly engaging a drill floor connector structure with a drawworks connection apparatus, moving the movement apparatus away from the drilling rig, securing the drawworks to the drill floor with a securement device, and raising the drill floor with the drawworks connected thereto to a desired operational height.

15. A method for installing a drawworks on a drilling rig on a surface, the method comprising moving the drawworks on a movement apparatus on the surface adjacent to a drill floor of the drilling rig, the drilling rig having a substructure and raising apparatus on the substructure, and the drill floor having an interior open space into which the movement apparatus is selectively movable with the drawworks thereon, moving the drawworks into the interior open space of the drill floor on the movement apparatus, and connecting the drawworks to the drill floor.

16. The method of claim 15 further comprising raising the drill floor with the drawworks connected thereto using the raising apparatus.

17. The method of claim 15 wherein connecting the drawworks to the drill floor comprises raising the drill floor to connectingly engage a drill floor connector structure with a drawworks connection apparatus.

18. The method of claim 15 further comprising securing the drawworks to the drill floor with a securement device.

19. The method of claim 15 further comprising positioning the drawworks with respect to the drill floor so that a top of a skid comprising the drawworks is substantially level with the drill floor.

20. A drill floor comprising a floor section with an interior open space, wherein the interior open space is adapted to facilitate movement thereinto of a movement apparatus with a drawworks thereon, and a movable drill floor connector structure adapted to connectingly engage a drawworks connection apparatus.

21. A method for installing a rig apparatus on a drilling rig, comprising positioning the drawworks on a movement apparatus comprising a truck-trailer combination, wherein a trailer of the truck-trailer combination is connected to and moveable by a truck of the truck-trailer combination, moving the rig apparatus with the movement apparatus on a surface adjacent to a drill floor of the drilling rig, the drilling rig having a substructure and raising apparatus on the substructure, connecting the rig apparatus to the drill floor, by raising the drill floor with the rig apparatus connected thereto using the raising apparatus and connectingly engaging a drill floor connector structure with a rig apparatus connection apparatus, moving the movement apparatus away from the drilling rig, securing the rig apparatus to the drill floor with a securement device, and raising the drill floor with the rig apparatus connected thereto to a desired operational height.

* * * * *